United States Patent [19]

Wanner et al.

[11] Patent Number: 5,066,458

[45] Date of Patent: Nov. 19, 1991

[54] HEAT RESISTING CONTROLLED THERMAL EXPANSION ALLOY BALANCED FOR HAVING GLOBULAR INTERMETALLIC PHASE

[75] Inventors: Edward A. Wanner, Leesport; Sunil Widge, Dryville, both of Pa.

[73] Assignee: Carpenter Technology Corporation, Reading, Pa.

[21] Appl. No.: 313,753

[22] Filed: Feb. 22, 1989

[51] Int. Cl.[5] ..... C22C 38/52; B32B 15/04

[52] U.S. Cl. ..... 420/586

[58] Field of Search ..... 420/581, 586, 57, 58

[56] References Cited

U.S. PATENT DOCUMENTS

| | | | |
|---|---|---|---|
| 4,006,011 | 2/1977 | Muzyka et al. | 420/586 |
| 4,200,459 | 4/1980 | Smith, Jr. et al. | 420/447 |
| 4,487,743 | 12/1984 | Smith et al. | 420/586 |
| 4,900,640 | 2/1990 | Bell et al. | 428/633 |

FOREIGN PATENT DOCUMENTS

| | | | |
|---|---|---|---|
| 60-17048 | 1/1985 | Japan . | |
| 60-26646 | 2/1985 | Japan . | |
| 61-270270 | 11/1986 | Japan . | |
| 675622 | 7/1952 | United Kingdom | 420/586 |
| 1411693 | 5/1974 | United Kingdom | 420/95 |

OTHER PUBLICATIONS

D. F. Smith, et al., *Improving the Notch-Rupture Strength of Low-Expansion Superalloys*, Proc. of the 4 Int'l. Sym. on Superalloys 1980 (9/80).

*Primary Examiner*—Upendra Roy

*Attorney, Agent, or Firm*—Dann, Dorfman, Herrell and Skillman

[57] ABSTRACT

A heat resisting, controlled thermal expansion, nickel iron base alloy consisting essentially of, in weight percent, about:

| | |
|---|---|
| C | 0.1 max. |
| Mn | 0.5 max. |
| Si | a small but effective amount up to 0.7 |
| P | 0.015 max. |
| S | 0.010 max. |
| Cr | 0.8 max. |
| Ni | 32–52 |
| Mo | 0.5 max. |
| Co | 0–20 |
| Ti | 1–3 |
| Al | 0.2 max. |
| Nb | 5–7 |
| V | 0.5 max. |
| Zr | 0.1 max. |
| B | 0–0.02 |
| Cu | 0.8 max. |
| W | 0.5 max. |
| Fe | Bal. |

and an article formed therefrom are disclosed. The alloy provides an outstanding combination of elevated temperature tensile properties and notch rupture ductility by close control of the niobium and titanium in the alloy. Within the compositional range of the alloy niobium and titanium are balanced such that (a) % Nb$\geqq$6.7−0.5(% Ti), for Ti$\leqq$1.5%;

(b) % Nb$\geqq$18.3−8.2(% Ti), for Ti$\geqq$1.5%; and (c) % Ti$\leqq$0.67(% Nb−1.3). Furthermore, the sum, % Mn+% Cr+% Mo+% V+% Cu+% W$\leqq$2.

27 Claims, No Drawings

HEAT RESISTING CONTROLLED THERMAL EXPANSION ALLOY BALANCED FOR HAVING GLOBULAR INTERMETALLIC PHASE

BACKGROUND OF THE INVENTION

This invention relates to precipitation hardenable, nickel-iron base alloys, with or without cobalt, and articles made therefrom, that contain niobium, titanium, and silicon, and in particular, to such an alloy and article in which the elements are critically balanced to provide a unique combination of controlled thermal expansion and good elevated temperature tensile and stress rupture properties.

The high in-service temperatures to which controlled thermal expansion, high temperature nickel-iron base and nickel-cobalt-iron base alloys are exposed in use, are expected to become still higher. Furthermore, the requirements for the stress rupture and tensile properties of such alloys are becoming ever more stringent. Accordingly, a need has arisen for a high temperature, controlled thermal expansion alloy having better notch and combination smooth/notch stress rupture properties together with higher tensile strength and better ductility than the known high temperature, controlled thermal expansion alloys.

Furthermore, the age hardening heat treatments specified by the users of high temperature, controlled thermal expansion alloys are becoming shorter in duration and it is necessary that such Ni-Fe base and Ni-Co-Fe base alloys be capable of attaining the required strength within such shortened aging cycles.

The nickel-cobalt-iron base, precipitation strengthenable alloy disclosed in U.S. Pat. No. 4,006,011 ('011) issued to Muzyka et al. on Feb. 1, 1977 provides a good combination of very high room temperature tensile strength, about 145–150 ksi, together with a low coefficient of thermal expansion. In practice, however, it has been found that thermomechanical processing of the alloy can result in the mechanical properties of the wrought alloy being directional or anisotropic.

The alloy described in U.S. Pat. No. 4,200,459, issued to Smith, Jr. et al. on Apr. 29, 1980 sought to provide adequate notch rupture properties in a nickel-iron base, age-hardenable, controlled thermal expansion alloy without thermomechanical processing. To this end the patent describes complex relationships for balancing the hardener elements, Nb, Ti and Al with the other constituents. Although overaging of the alloy was recommended to benefit notch rupture ductility, the use of such overaging heat treatments results in markedly lower peak or short term tensile strength than was provided by the alloy of the '011 patent. It was found in practice that the precipitation of one or more secondary phases during such overaging heat treatments depleted the alloy of the primary strengthening phase.

U.S. Pat. No. 4,487,743 ('743) issued to Smith et al. on Dec. 11, 1984 relates to nickel-iron base and nickel-cobalt-iron base alloys which include silicon for the stated purpose of improving stress rupture notch strength without the necessity of an overaging heat treatment. Experience with the alloy of the '743 patent has shown that the stress rupture properties of the alloy are dependent on mechanical processing to a large degree and thus not consistently attainable, particularly when the alloy is exposed to very high temperature during manufacturing operations such as brazing, coating and others.

SUMMARY OF THE INVENTION

Accordingly, it is a principal object of this invention to provide a precipitation hardenable controlled thermal expansion, nickel-iron base alloy, and an article made therefrom, with or without cobalt, which are characterized by a unique combination of strength and ductility.

More specifically, it is an object of this invention to provide such an alloy and article in which the elements are critically balanced to provide a better combination of elevated temperature yield strength and stress rupture ductility than provided by the known alloys.

Another object of this invention is to provide a heat resisting, precipitation hardenable alloy which can be aged to very high hardness and tensile strength with a relatively short aging heat treatment.

A further object of this invention is to provide such an alloy which provides both high strength and good stress rupture ductility after exposure to very high temperatures.

The foregoing, as well as additional objects and advantages of the present invention, are achieved in a precipitation hardenable, nickel-iron base alloy and article made therefrom as summarized in Table I below, containing in weight percent, about:

TABLE I

| | Broad | Intermediate | Preferred |
|---|---|---|---|
| C | 0.1 max. | 0.05 max. | 0.03 max. |
| Mn | 0.5 max. | 0.5 max. | 0.2 max. |
| Si | Small but effective amount up to 0.7 | 0.1–0.5 | 0.2–0.4 |
| P | 0.015 max. | 0.005 max. | 0.005 max. |
| S | 0.010 max. | 0.005 max. | 0.005 max. |
| Cr | 0.8 max. | 0.8 max. | 0.5 max. |
| Ni | 32–52 | 35–42 | 36–40 |
| Mo | 0.5 max. | 0.5 max. | 0.2 max. |
| Co | up to 20 | 5–18 | 10–17 |
| Ti | 1–3 | 1.2–2.5 | 1.5–2.4 |
| Al | 0.5 max. | 0.2 max. | 0.1 max. |
| Nb | 5–7 | 5.2–6.5 | 5.4–6.4 |
| V | 0.5 max. | 0.5 max. | 0.2 max. |
| Zr | 0.1 max. | 0.1 max. | 0.05 max. |
| B | up to 0.02 | Small but effective amount up to 0.02 | 0.002–0.01 |
| Cu | 0.8 max. | 0.8 max. | 0.5 max. |
| W | 0.5 max. | 0.5 max. | 0.2 max. |

the balance of the alloy is essentially iron, in which:

a) % Nb$\geqq$6.7−0.5(% Ti) for Ti$\leqq$1.5%;

b) % Nb$\geqq$18.3−8.2(% Ti) for Ti$\geqq$1.5%;

c) % Ti$\leqq$0.67(% Nb)−1.3; and the sum, % Mn+% Cr+% Mo+% V+% Cu+% W, is not more than about 2, preferably not more than about 1. Furthermore, up to about 0.01% max., each of calcium, magnesium and/or cerium can be present as residuals from deoxidizing and/or desulfurizing additions.

The foregoing tabulation is provided as a convenient summary and is not intended to restrict the lower and upper values of the ranges of the individual elements of the alloy of this invention for use solely in combination with each other, or to restrict the broad, intermediate or preferred ranges of the elements for use solely in combination with each other. Thus, one or more of the broad, intermediate, and preferred ranges can be used with one or more of the other ranges for the remaining elements. In addition, a broad, intermediate, or preferred minimum or maximum for an element can be used with the maximum or minimum for that element from one of the remaining ranges.

Here and throughout this application percent (%) means percent by weight, unless otherwise indicated. Furthermore, it is intended by reference to niobium to include the usual amount of tantalum found in commercially available niobium used in making alloying additions of niobium to commercial alloys.

DETAILED DESCRIPTION

In the alloy according to the present invention, nickel, iron, and, when present, cobalt act together to provide an austenitic matrix structure, which is thermally stable to very low temperatures. Nickel and cobalt both contribute to the low thermal expansion property as well as the elevated inflection temperature of the alloy. Nickel, cobalt, and iron also react with one or more of the elements niobium, titanium, aluminum, and silicon to form strengthening phases brought out as intragranular and/or intergranular precipitates primarily by an age hardening heat treatment and also, though to a lesser extent, during cooling after solution treatment, as those heat treatments are discussed more fully hereinbelow. In order to ensure that sufficient nickel is available for the foregoing purposes, at least about 32%, better yet at least about 35%, and for best results at least about 36% nickel is present. Cobalt may be substituted for some of the nickel on a one-to-one basis in weight percent. Although cobalt is optional, preferably at least about 5%, better yet, at least about 10% cobalt is present because it benefits the attainment of the desired thermal expansion coefficient and inflection temperature of the alloy.

The benefits realized from nickel and cobalt diminish in value at higher levels of those elements so that the added cost thereof is not warranted. Furthermore, to much nickel and/or cobalt in substitution for some of the iron causes the coefficient of thermal expansion to increase. Accordingly, nickel is limited to not more than about 52%, better yet to not more than about 42%, and preferably to not more than about 40%. In like manner, cobalt, when present, is limited to not more than about 20%, better yet to not more than about 18% and preferably to not more than about 17%.

Niobium and titanium are present in this alloy primarily for their contribution to the higher strength provided by the alloy. Portions of the niobium and titanium react with some of the nickel and iron, or cobalt when present, to form strengthening phases during age hardening heat treatment of the alloy. Depending on the particular composition, some of the phases which may precipitate in the alloy are the known gamma prime, gamma double-prime, eta, and/or delta phases. Additionally, a globular, intermetallic phase, containing nickel, niobium, and silicon, precipitates intra- and/or intergranularly in the alloy during hot or warm working operations. Here and throughout this application, the term "globular" means a shape which is irregularly rounded and does not include sharp angles. The term "globular" is intended to encompass, but is not limited to, ellipsoids, oblate or prolate spheroids, tear-drop shapes, and pear shapes, as well as combinations thereof. This Ni-Nb-Si phase precipitates out of solid solution when the present alloy is treated at temperatures of at least 1675F. up to temperatures above the solvus temperatures of the other phases. The Ni-Nb-Si phase has a higher solvus temperature than those corresponding to the other phases. Due to its relatively high solvus temperature, a significant amount of the Ni-Nb-Si phase remains out of solution when the alloy is heated up to about 1950F.

The Ni-Nb-Si phase precipitates as globular particles having a major diameter of about 0.1–2 micrometers. The presence of the Ni-Nb-Si phase benefits the stress rupture properties, particularly the stress rupture ductility, of the alloy.

In order to ensure the presence of a sufficient quantity of the strengthening phases to provide the high strength that is characteristic of this alloy, at least about 5%, better yet at least about 5.2%, and preferably at least about 5.4% niobium is present in this alloy. Furthermore, at least about 1%, better yet at least about 1.2%, and preferably at least about 1.5%, titanium is present in the alloy.

Too much niobium and titanium adversely affect the low thermal expansion coefficient and the high inflection temperature which are characteristic of this alloy. Moreover, too much niobium results in undesirably low room and elevated temperature tensile and yield strengths from this alloy, as well as low notch rupture strength. Niobium is limited, therefore, to not more than about 7%, better yet to not more than about 6.5%, and preferably to not more than about 6.4%.

In addition to the adverse effect of too much titanium on the thermal expansion properties of this alloy, the tensile and stress rupture ductilities of the alloy are adversely affected when too much titanium is present in this alloy. Accordingly not more than about 3%, better yet not more than about 2.5%, and preferably not more than about 2.4% titanium is present in this alloy.

Within the above-described ranges niobium and titanium are controlled in order to provide the unique combination of strength and ductility that is characteristic of the present alloy. Accordingly, in order to provide the desired room temperature yield strength:

(a) $\% \text{ Nb} \geqq 6.7 - 0.5(\% \text{ Ti})$, for $\text{Ti} \leqq$ about 1.5%; and (b) $\% \text{ Nb} \geqq 18.3 - 8.2(\% \text{ Ti})$, for $\text{Ti} \geqq$ about 1.5%.

In order to provide the desired elevated temperature tensile ductility:

(c) $\% \text{ Ti} \leqq 0.67(\% \text{ Nb}) - 1.3$.

The best combination of room temperature yield strength and elevated temperature ductility is provided with about 5.5–6.2% niobium and about 1.7–2.2% titanium in this alloy.

When more than about 5.5% niobium is present in this alloy, titanium is preferably limited such that:

(d) $\% \text{ Ti} \leqq 5.1 - 0.5(\% \text{ Nb})$ to provide the best room temperature tensile ductility.

Over the broad, intermediate, or preferred ranges of this alloy, the best elevated temperature yield strength is realized when:

(e) $\% \text{ Nb} \leqq 5.3 + 0.6(\% \text{ Ti})$.

A small but effective amount of silicon is present in this alloy because it contributes to the notch rupture life and combination smooth-notch rupture ductility of the alloy by reacting with nickel and niobium as described above to form the nickel-niobium-silicon phase. Better yet, at least about 0.1%, and preferably at least about 0.2% silicon is present. Not more than about 0.7%, better yet not more than about 0.5%, and preferably not more than about 0.4% silicon is present in this alloy because of the increasingly adverse effect of higher levels of silicon on the tensile and yield strengths. For best results about 0.25–0.30% silicon is present in this alloy.

Other elements may be present in the alloy as optional additions or as residuals resulting from the melting practice utilized. For example, up to about 0.5% max., better yet up to about 0.2% max., and preferably up to about 0.1% max. aluminum can be present in this alloy. Up to about 0.5% max., preferably up to about 0.2% max. of each of manganese, molybdenum, vanadium and/or tungsten can be present. In like manner, up to about 0.8% max., preferably up to about 0.5% max. of each of chromium and copper can be present. Manganese, molybdenum, vanadium, tungsten, chromium and copper can be present up to the stated amounts with the proviso that the sum total of their respective weight percents is not more than about 2 max., preferably not more than about 1 max., because of their adverse effect on the alloy's inflection temperature and coefficient of thermal expansion.

Up to about 0.01% max., preferably up to about 0.005% max., each of calcium, magnesium and/or cerium can be present from deoxidizing and/or desulfurizing additions and also to benefit the desired mechanical properties, such as elevated temperature tensile ductility and stress rupture ductility.

A small but effective amount of boron can be present in this alloy and the preferred composition contains at least about 0.002%, e.g., about 0.005%, boron. When present, this small amount of boron is believed to prevent the precipitation of undesirable phases in the grain boundaries and thus to improve stress rupture life and ductility. Boron is limited to not more than 0.020%, however, and preferably to not more than about 0.01% in the present alloy.

This alloy can contain up to about 0.1% max., preferably up to about 0.05% max. zirconium for the same reasons as boron.

The balance of the alloy is iron except for the usual impurities found in commercial grades of alloys for the same or similar service or use. However, the levels of such impurity elements must be controlled so as not to adversely affect the desired properties of the present alloy. In this regard carbon is restricted to not more than about 0.1% max., better yet to not more than about 0.05% max., and preferably to not more than about 0.03% max. Phosphorus is limited to not more than about 0.015%, preferably to not more than about 0.005% max.; and sulfur is limited to not more than about 0.010% max., preferably to not more than about 0.005% max.

The alloy of the present invention is readily melted using conventional vacuum melting techniques. For best results when additional refining is desired, a multiple melting practice is preferred. For example, the preferred commercial practice is to melt a heat in a vacuum induction furnace (VIM) and cast the heat in the form of an electrode. The electrode is then remelted in a vacuum arc furnace (VAR) and recast into one or more ingots. Ingots of this alloy are usually homogenized to minimize any compositional gradients. When homogenization is performed for this alloy it is preferably carried out between 2050–2175F. for or more so as not to increase ingot porosity.

This alloy can also be prepared by powder metallurgy techniques.

The alloy is hot workable from about 2100F. to its recrystallization temperature, but is preferably hot worked from about 2050–1900F. Warm working of the alloy can be performed to well below the recrystallization temperature, for example to about 1700F. Solution treatment of the alloy is preferably carried out after hot or warm working. The alloy is solution treated preferably at about 1650–1950F. for a time commensurate with the size of the article being heat treated. In this regard, solution treatment is carried out for about one hour at temperature per inch of metal thickness, but not less than ¼ hour. Solution treatment of the alloy is concluded by cooling the article in air.

Precipitation or age hardening of the alloy is preferably conducted by heating the alloy at about 1275–1500F. for about 2–8 hours. Thereafter, the alloy is cooled in a controlled manner, as by furnace cooling to a temperature in the range 1100–1300F. and held at such temperature for at least about 2–8 hours. It is a distinct advantage of the alloy according to the present invention that it can attain high strength levels even when shortened aging heat treatments of not more than 10–12 hours are required.

When thus solution treated and age hardened after hot and/or warm working, the alloy of the present invention provides, and articles made from the alloy exhibit, a unique combination of elevated temperature tensile strength and stress rupture ductility. For example, when solution treated at 1800F. for 1 h and air cooled, aged at 1325F. for 8 h, furnace cooled at 100° F. per hour to 1150F., held at that temperature for 8 h and then air cooled, the preferred composition of this alloy provides a 0.2% offset yield strength at 1200F. of at least 145 ksi together with a combination smooth/notch stress rupture elongation at 1200F./74 ksi (stress concentration factor, $K_t=3.7$) of at least 25%. Moreover, when the preferred composition of this alloy is solution treated at 1900F. for 1 h and air cooled, aged at 1425F. for 8 h, furnace cooled at 100F. per hour to 1150F., held at that temperature for 8 h and then air cooled, a 0.2% offset yield strength at 1200F. of at least 115 ksi together with a combination smooth/notch stress rupture elongation at 1200F./74 ksi of at least 20% is realized.

TABLE II

| Ex. | C | Mn | Si | P | S | Cr | Ni | Mo | Co | Ti | Al | Nb | V | Zr | B |
|---|---|---|---|---|---|---|---|---|---|---|---|---|---|---|---|
| 1 | 0.019 | 0.08 | 0.21 | <0.005 | 0.001 | 0.09 | 38.04 | <0.01 | 13.57 | 1.25 | 0.07 | 6.26 | <0.01 | 0.002 | 0.006 |
| 2 | 0.020 | 0.08 | 0.22 | <0.005 | 0.001 | 0.10 | 38.25 | <0.01 | 13.65 | 1.54 | 0.06 | 6.34 | <0.01 | 0.002 | 0.006 |
| 3 | 0.010 | 0.08 | 0.26 | 0.002 | 0.002 | 0.10 | 37.92 | 0.01 | 13.61 | 1.75 | 0.07 | 6.23 | <0.01 | N/A | 0.006 |
| 4 | 0.016 | 0.08 | 0.25 | 0.002 | 0.002 | 0.09 | 38.21 | 0.01 | 13.72 | 1.96 | 0.07 | 6.27 | <0.01 | N/A | 0.006 |
| 5 | 0.019 | 0.07 | 0.23 | <0.005 | 0.001 | 0.10 | 38.15 | <0.01 | 13.52 | 1.54 | 0.06 | 6.03 | <0.01 | 0.005 | 0.006 |
| 6 | 0.021 | 0.07 | 0.25 | <0.005 | 0.001 | 0.10 | 38.49 | <0.01 | 13.72 | 1.72 | 0.06 | 6.01 | <0.01 | 0.006 | 0.006 |
| 7 | 0.022 | 0.07 | 0.25 | 0.005 | 0.001 | 0.10 | 38.26 | 0.01 | 13.70 | 1.97 | 0.07 | 6.04 | <0.01 | N/A | 0.005 |
| 8 | 0.015 | 0.08 | 0.26 | 0.002 | 0.002 | 0.09 | 38.49 | 0.01 | 13.73 | 2.13 | 0.07 | 5.98 | <0.01 | N/A | 0.006 |
| 9 | 0.016 | 0.09 | 0.29 | <0.005 | 0.001 | 0.10 | 38.53 | <0.01 | 13.69 | 1.77 | 0.06 | 5.66 | <0.01 | 0.006 | 0.006 |
| 10 | 0.017 | 0.09 | 0.28 | <0.005 | 0.001 | 0.10 | 38.31 | <0.01 | 13.68 | 1.96 | 0.06 | 5.68 | <0.01 | 0.005 | 0.007 |
| 11 | 0.017 | 0.08 | 0.26 | 0.002 | 0.002 | 0.09 | 38.57 | 0.01 | 13.78 | 2.16 | 0.06 | 5.66 | <0.01 | N/A | 0.007 |
| 12 | 0.017 | 0.08 | 0.26 | 0.002 | 0.002 | 0.10 | 38.86 | 0.01 | 13.74 | 2.32 | 0.07 | 5.66 | <0.01 | N/A | 0.006 |
| 13 | 0.017 | 0.08 | 0.25 | 0.002 | 0.002 | 0.10 | 38.28 | 0.01 | 13.76 | 1.93 | 0.07 | 5.27 | <0.01 | N/A | 0.006 |

TABLE II-continued

| Ex. | C | Mn | Si | P | S | Cr | Ni | Mo | Co | Ti | Al | Nb | V | Zr | B |
|---|---|---|---|---|---|---|---|---|---|---|---|---|---|---|---|
| 14 | 0.010 | 0.07 | 0.25 | 0.002 | 0.002 | 0.09 | 38.60 | 0.01 | 13.67 | 2.16 | 0.06 | 5.23 | <0.01 | N/A | 0.005 |
| 15 | 0.013 | 0.07 | 0.26 | 0.002 | 0.002 | 0.09 | 38.99 | 0.01 | 13.64 | 2.35 | 0.06 | 5.25 | <0.01 | N/A | 0.006 |
| A | 0.020 | 0.08 | 0.25 | <0.005 | 0.001 | 0.10 | 38.57 | <0.01 | 13.66 | 1.52 | 0.06 | 5.55 | <0.01 | 0.004 | 0.006 |
| B | 0.020 | 0.08 | 0.24 | <0.005 | 0.001 | 0.09 | 38.13 | <0.01 | 13.66 | 1.55 | 0.06 | 4.82 | <0.01 | 0.003 | 0.006 |
| C | 0.024 | 0.08 | 0.27 | <0.005 | 0.001 | 0.10 | 37.68 | <0.01 | 13.62 | 1.97 | 0.08 | 4.78 | <0.01 | 0.004 | 0.007 |
| D | 0.011 | 0.07 | 0.26 | 0.002 | 0.001 | 0.08 | 38.97 | 0.01 | 13.67 | 2.36 | 0.06 | 4.88 | <0.01 | N/A | 0.006 |

N/A = Not analyzed.

EXAMPLES

As examples of the alloy of the present invention, example Heats 1-15 having the compositions in weight percent shown in Table II were prepared. By way of comparison, example Heats A-D, the compositions in weight percent of which are also shown in Table II, were prepared. Heats 1, 2, 5, 6, 9, and 10, and Heats A-C were split cast from five 400 lb. VIM heats into 4 in. round ingot/electrodes. The ingot/electrodes were VAR remelted into 8 in. round ingots. Heats 3, 4, 7, 8, 11-15, and Heat D were cast from 17 lb. VIM heats as 3½ in. square ingots. All heats were deoxidized with a 0.05% calcium addition.

All of the ingots were homogenized and then forged as follows. The 8 in. round ingots were forged from 2050F. to 5 in. square, reheated to 1900F., forged to 3 in. square, reheated to 1900F. forged to 1½ in. square, reheated to 1700F., and then forged to ¾ in. square bars. The 3½ in. square ingots were forged from 2050F. to 2½ in. square, reheated to 1900F., forged to 1½ in. square reheated to 1700F., and then forged to ¾ in. square bars.

Blanks for room and elevated temperature tensile specimens for combination smooth/notch stress rupture specimens and for dilatometer specimens were rough machined from each of the forged bars. All blanks were cut with a longitudinal orientation. Half of the blanks were heat treated by solution treatment at 1900F. for 1 h then cooling in air followed by aging at 1425F. for 8 h, cooling at the rate of 100F.°/h to 1150F., holding at that temperature for 8 h and then cooling in air. The other half of the blanks were heat treated by solution treatment at 1800F. for 1 h, then cooling in air, followed by aging at 1325F. for 8 h, cooling at the rate of 100F.°/h to 1150F., holding at that temperature for 8 h, and then cooling in air.

Standard subsize tensile test specimens (0.252 in gage diam.) were finish machined from the heat treated blanks. Standard combination smooth/notch stress rupture test specimens (0.178 in gage diam./0.178 in notch diam.; $K_t=3.7$) were machined by low stress grinding, from other of the heat treated blanks. In addition, 2 in. long by 0.180 in. diameter dilatometer specimens were finish machined from the remaining heat treated blanks for expansion testing.

The results of room temperature and 1200F. tensile tests and the results of the stress rupture tests are tabulated in Table III for the specimens that were solution treated at 1800F. with the weight percents of niobium and titanium for each specimen. The tensile data are presented in Table III as the averages of duplicate tests, except as noted, and include the 0.2% offset yield strength (Y.S.) and ultimate tensile strength (U.T.S.) in ksi, as well as the percent elongation (% El.) and the percent reduction in cross-sectional area (% R.A.).

Stress rupture testing was carried out on the combination smooth/notch specimens by applying a constant load at 1200F. to generate an initial stress of 74 ksi. The stress rupture data presented in Table III are reported as the averages of duplicate tests and include the time to failure in hours (Rupt. Life), as well as the percent elongation (% El.).

TABLE III

| | | | (1800 F. Solution Treatment) | | | | | | | | | |
|---|---|---|---|---|---|---|---|---|---|---|---|---|
| | | | R.T. Tensile | | | | 1200 F. Tensile | | | | 1200 F./74 ksi Stress Rupt. | |
| Ex. | % Nb | % Ti | Y.S. | U.T.S. | % El. | % R.A. | Y.S. | U.T.S. | % El. | % R.A. | Rupt. Life | % El. |
| 1 | 6.26 | 1.25 | 181.8 | 217.1 | 11.3 | 28.4 | 132.2 | 145.3 | 21.3 | 53.4 | 116.8 | 33.2 |
| 2 | 6.34 | 1.54 | 174.4 | 209.2 | 14.7 | 35.2 | 138.2 | 158.0 | 17.3 | 44.4 | 171.2 | 32.8 |
| 3 | 6.23 | 1.75 | 178.1 | 214.6 | 9.2 | 23.4 | 150.0 | 163.0 | 22.2 | 67.0 | 206.4 | 40.0 |
| 4 | 6.27 | 1.96 | 184.4 | 221.0 | 8.8 | 23.4 | 162.9* | 178.6 | 16.0 | 53.8 | 246.2 | 31.8 |
| 5 | 6.03 | 1.54 | 170.6 | 209.7 | 13.0 | 22.4 | 149.3 | 159.6 | 14.4 | 37.0 | 165.4 | 37.4 |
| 6 | 6.01 | 1.72 | 176.0 | 212.2 | 14.0 | 28.6 | 152.5 | 166.8 | 12.3 | 26.0 | 193.6 | 33.2 |
| 7 | 6.04 | 1.97 | 184.4 | 219.9 | 11.6 | 25.2 | 154.9 | 167.0 | 18.5 | 58.5 | 301.2 | 33.9 |
| 8 | 5.98 | 2.13 | 195.2 | 225.0 | 7.4 | 22.0 | 166.0 | 177.3 | 17.3 | 46.5 | 313.1 | 33.3 |
| 9 | 5.66 | 1.77 | 176.6 | 212.5 | 10.6 | 24.3 | 151.7 | 162.2 | 13.1 | 35.6 | 183.7 | 35.0 |
| 10 | 5.68 | 1.96 | 163.6 | 199.6 | 12.8 | 32.2 | 160.4 | 172.4 | 11.0 | 23.6 | 249.6 | 32.0 |
| 11 | 5.66 | 2.16 | 188.9 | 222.9 | 12.8 | 37.0 | 167.0 | 179.8 | 12.3 | 37.8 | 295.8 | 29.8 |
| 12 | 5.66 | 2.32 | 194.6 | 227.4 | 9.8 | 29.3 | 168.5 | 183.9 | 15.6 | 40.6 | 328.2 | 31.4 |
| 13 | 5.27 | 1.93 | 181.6 | 213.6 | 11.9 | 33.4 | 155.1 | 169.0 | 14.0 | 34.5 | 267.1 | 28.2 |
| 14 | 5.23 | 2.16 | 188.1 | 207.6 | 11.5 | 34.6 | 163.0 | 175.3 | 8.2 | 21.4 | 328.9 | 33.7 |
| 15 | 5.25 | 2.35 | 194.2 | 224.0 | 11.4 | 34.6 | 168.0 | 180.5 | 8.0 | 17.8 | 380.5 | 35.3 |
| A | 5.55 | 1.52 | 167.3 | 206.6 | 12.6 | 22.5 | 143.2 | 154.0 | 13.7 | 34.2 | 147.4 | 30.1 |
| B | 4.82 | 1.55 | 165.7 | 202.1 | 16.2 | 33.7 | 139.1 | 152.5 | 14.0 | 35.0 | 159.6/3.3 | 25.4/NB |
| C | 4.78 | 1.97 | 177.6 | 211.5 | 12.6 | 39.1 | 154.5 | 166.8 | 8.7 | 22.2 | 281.1 | 13.9 |
| D | 4.88 | 2.36 | 195.4 | 221.4 | 11.8 | 36.4 | 160.3 | 171.2 | 5.2 | 7.8 | 433.6/3.4 | 21.9/NB |

*Single test result.
NB = Notch Break.

Table III illustrates the good combination of strength and stress rupture ductility provided by this alloy as compared to other compositions in which the elements are not balanced in accordance with the present invention.

The results of room temperature and 1200F. tensile tests and the results of the stress rupture tests for the 1900F. solution treated specimens are tabulated in Table IV with the weight percents of niobium and titanium for each specimen. The data are again reported as the average of duplicate tests, except as noted. Stress rupture testing was again carried out at 1200F. with an initial stress of 74 ksi at constant load.

Table IV shows the good combination of elevated temperature yield strength and stress rupture ductility provided by this alloy when solution treated at very high temperature. The data of Table IV also illustrate the ability of this alloy to provide both high strength and good stress rupture ductility when aged after it is exposed to very high temperature treatment.

The results of expansion testing for both the 1800F. and 1900F. solution treated specimens are shown in Table V, including the coefficient of thermal expansion (C.O.E.) in $\mu$ in/in/F.° ($10^{-6}$/F.°) and the inflection temperature (Infl. Temp.) in degrees Fahrenheit (F). The coefficient of thermal expansion was determined from expansion measurements taken while increasing the temperature of each specimen from room temperature up to about 900F. with measurements taken about every 15 degrees and is reported as the mean coefficient of linear thermal expansion from room temperature to 780F.

TABLE IV (1900 F. Solution Treatment)

| | | | R.T. Tensile | | | | 1200 F. Tensile | | | | 1200 F./74 ksi Stress Rupt. | |
|---|---|---|---|---|---|---|---|---|---|---|---|---|
| Ex. | % Nb | % Ti | Y.S. | U.T.S. | % El. | % R.A. | Y.S. | U.T.S. | % El. | % R.A. | Rupt. Life | % El. |
| 1 | 6.26 | 1.25 | 125.0 | 178.0 | 9.8 | 13.4 | 102.0 | 127.9 | 23.2 | 53.3 | 78.4 | 32.4 |
| 2 | 6.34 | 1.54 | 133.9 | 187.2 | 11.2 | 15.9 | 96.6 | 134.4 | 24.0 | 55.2 | 113.3 | 30.2 |
| 3 | 6.23 | 1.75 | 127.5 | 180.2 | 7.7 | 13.4 | 103.7 | 133.8 | 27.0 | 74.6 | 104.7 | 34.6 |
| 4 | 6.27 | 1.96 | 129.5 | 179.4 | 5.1 | 9.3 | 107.5 | 134.9 | 26.5 | 71.7 | 115.6 | 28.2 |
| 5 | 6.03 | 1.54 | 130.8 | 191.4 | 12.2 | 15.6 | 108.4 | 133.5 | 23.0 | 48.6 | 119.4 | 30.0 |
| 6 | 6.01 | 1.72 | 128.7* | 183.4 | 9.4 | 12.6 | 108.0 | 136.6 | 24.4 | 58.6 | 110.4 | 28.4 |
| 7 | 6.04 | 1.97 | 128.6 | 182.8 | 12.5 | 13.7 | 109.9 | 135.5 | 23.5 | 60.4 | 118.4 | 33.4 |
| 8 | 5.98 | 2.13 | 132.8 | 187.5 | 6.8 | 12.0 | 113.9 | 140.8 | 21.4 | 55.8 | 132.5 | 33.4 |
| 9 | 5.66 | 1.77 | 136.4 | 182.0 | 19.2 | 14.6 | 119.6* | 144.9 | 20.9 | 47.8 | 125.6 | 15.0 |
| 10 | 5.68 | 1.96 | 142.0 | 189.2 | 9.6 | 14.4 | 118.1 | 142.6 | 18.5 | 41.4 | 144.8 | 27.1 |
| 11 | 5.66 | 2.16 | 149.3 | 190.4 | 9.0 | 12.3 | 127.1 | 154.5 | 14.4 | 30.3 | 190.1 | 34.7 |
| 12 | 5.66 | 2.32 | 157.8 | 193.6 | 6.6 | 11.6 | 137.6 | 157.9 | 10.4 | 23.5 | 288.6 | 13.1 |
| 13 | 5.27 | 1.93 | 144.4 | 182.5 | 10.4 | 16.4 | 124.2 | 147.1 | 14.4 | 29.0 | 277.8 | 32.4 |
| 14 | 5.23 | 2.16 | 154.8 | 188.9 | 8.5 | 13.8 | 132.4 | 155.5 | 9.4 | 18.5 | 276.5 | 40.0 |
| 15 | 5.25 | 2.35 | 160.3 | 195.2 | 7.8 | 13.87 | 138.0 | 157.7 | 8.8 | 13.0 | 355.7 | 22.1 |
| A | 5.55 | 1.52 | 131.0 | 176.8 | 11.3 | 14.4 | 112.4* | 135.0* | 14.8 | 31.9 | 153.4 | 19.0 |
| B | 4.82 | 1.55 | 133.6 | 176.8 | 15.8 | 22.4 | 108.5 | 134.0 | 14.6 | 26.8 | 128.2 | 5.0 |
| C | 4.78 | 1.97 | 145.3 | 182.0 | 12.4 | 20.0 | 124.2 | 153.5 | 11.7 | 24.0 | 185.0 | 2.2 |
| D | 4.88 | 2.36 | 161.3 | 191.6 | 8.9 | 16.7 | 137.3 | 158.5* | 11.8 | 40.0 | 343.3 | 26.5 |

*Single test result.

TABLE V

| | 1800 F. Sol. | | 1900 F. Sol. | |
|---|---|---|---|---|
| Ex. | COE | Infl. Temp. | COE | Infl. Temp. |
| 1 | 4.58 | 843 | 4.45 | 838 |
| 2 | 4.46 | 838 | 4.34 | 828 |
| 3 | 4.22 | 801 | 4.34 | 799 |
| 4 | 4.27 | 809 | 4.35 | 813 |
| 5 | 4.47 | 833 | 4.42 | 819 |
| 6 | 4.39 | 828 | 4.44 | 822 |
| 7 | 4.20 | 797 | 4.25 | 794 |
| 8 | 4.41 | 794 | 4.28 | 797 |
| A | 4.34 | 831 | 4.45 | 811 |
| 9 | 4.30 | 821 | 4.42 | 809 |
| 10 | 4.27 | 816 | 4.33 | 812 |
| 11 | 4.27 | 804 | 4.37 | 799 |

TABLE V-continued

| | 1800 F. Sol. | | 1900 F. Sol. | |
|---|---|---|---|---|
| Ex. | COE | Infl. Temp. | COE | Infl. Temp. |
| 12 | 4.31 | 807 | 4.41 | 794 |
| 13 | 4.19 | 805 | 4.32 | 795 |
| 14 | 4.20 | 804 | 4.36 | 795 |
| 15 | — | — | 4.41 | 805 |
| B | 4.38 | 833 | 4.27 | 828 |
| C | 4.15 | 804 | 4.21 | 799 |
| D | 4.24 | 811 | 4.36 | 807 |

Table V demonstrates that the present alloy provides a highly advantageous combination of thermal properties, namely a low coefficient of thermal expansion of about 4.0–4.5$\times 10^{-6}$/F.° from R.T. to 780F. and a high inflection temperature of about 800F. or higher.

To demonstrate the outstanding age hardening response provided by the alloy according to the present invention, a 300 lb. VIM heat, example Heat 16, having the composition in weight percent shown in Table VI was prepared,

TABLE VI

| | wt. % |
|---|---|
| C | 0.022 |
| Mn | 0.09 |
| Si | 0.22 |
| P | <0.005 |
| S | <5 ppm |
| Cr | 0.16 |
| Ni | 38.37 |
| Mo | 0.01 |
| Cu | <0.01 |
| Co | 13.72 |
| V | 0.01 |
| Ti | 2.14 |
| Al | 0.063 |
| Nb | 5.76 |
| B | 0.0066 |
| Fe | Bal. |

VAR remelted, and then cast as an 8 in. round ingot. The ingot was homogenized and then forged to ¾ in. square bar in the same manner as described above for example Heat no. 1. Cube samples for hardness testing were cut from the ¾ in. bar, solution treated at 100F. for 1 h, and cooled in air. The solution treated specimens were then aged with a two step aging heat treatment. The primary aging heat treatments are shown in Table VII by aging temperature (Temp.) in degrees Fahrenheit (F) and Time in hours. After primary aging, the cube samples were cooled in air and then finish ground to provide two smooth, parallel surfaces for hardness testing. The results of Rockwell hardness testing on the cube samples after primary aging are reported in Table VII as Rockwell C Scale hardness (Prim. Age HRC).

After hardness testing of the primary aged cube samples, they were given a secondary age in which the cube samples were heated up to 1350F., furnace cooled at 100° F.° per hour to 1150F., held at 1150F. for 4 h and then cooled in air. The results of Rockwell hardness testing after the secondary age are given in Table VII as Rockwell C Scale hardness (Sec. Age HRC). The hardness data in both cases represent the average of four tests for each sample.

TABLE VII

| Ex. | Temp. (F.) | Time (h) | Prim. Age HRC | Sec. Age HRC |
|---|---|---|---|---|
| 16A | 1325 | 2 | 43.4 | 48.0 |
| 16B | 1375 | 2 | 42.5 | 46.5 |
| 16C | 1425 | 2 | 38.8 | 44.4 |
| 16D | 1475 | 2 | 33.4 | 43.3 |
| 16E | 1300 | 4 | 44.8 | 47.0 |
| 16F | 1350 | 4 | 43.8 | 46.8 |
| 16G | 1400 | 4 | 39.4 | 43.4 |
| 16H | 1450 | 4 | 34.1 | 40.9 |
| 16I | 1275 | 6 | 45.0 | 47.6 |
| 16J | 1325 | 6 | 44.2 | 47.0 |
| 16K | 1375 | 6 | 40.6 | 44.6 |
| 16L | 1425 | 6 | 33.2 | 40.5 |
| 16M | 1275 | 8 | 44.8 | 47.6 |
| 16N | 1325 | 8 | 43.8 | 46.5 |
| 16O | 1375 | 8 | 40.1 | 44.1 |
| 16P | 1425 | 8 | 35.8 | 39.0 |

Table VII represents an aging study for the alloy of the present invention and shows that this alloy responds to age hardening heat treatment in very short times.

The alloy of the present invention is useful in a wide variety of applications, for example, jet aircraft engine and gas turbine parts, including, but not limited to, spacers, engine casings, diffusers, ducting, discs, rings, fasteners and other structural engine parts. In addition, this alloy is suitable for use in tools for the extrusion and/or die casting of copper and copper alloys, including such articles as extrusion die blocks, extrusion dummy blocks, extrusion liners, and die casting dies and die components. The alloy is especially well suited for the fabrication of parts requiring high temperature forming techniques such as brazing. The present alloy is, of course, also suitable for use in a variety of product forms such as castings, billets, bars, sheet, strip, rod, and wire.

It is apparent from the foregoing description and the accompanying examples, that the alloy according to the present invention provides a unique combination of tensile and stress rupture properties well suited to a wide variety of uses. This alloy is also characterized by both high strength and good stress rupture ductility when age hardened after exposure to very high temperature treatments, for example, 1900F. Moreover, the alloy provides a further distinctive advantage because it can be age-hardened in a significantly shorter time than required for the known high temperature, controlled thermal expansion alloys.

The terms and expressions which have been employed are used as terms of description and not of limitation. There is no intention in the use of such terms and expressions of excluding any equivalents of the features shown and described or portions thereof. It is recognized, however, that various modifications are possible within the scope of the invention claimed.

What is claimed is:

1. A precipitation hardenable, nickel-iron base alloy, said alloy being balanced for precipitating a globular intermetallic phase and having a good combination of elevated temperature strength and ductility, said alloy consisting essentially of, in weight percent, about

| | wt. % |
|---|---|
| Carbon | 0.1 max. |
| Manganese | 0.5 max. |
| Silicon | A small but effective amount up to 0.7 |
| Phosphorus | 0.015 max. |
| Sulfur | 0.010 max. |
| Chromium | 0.8 max. |
| Nickel | 32–52 |
| Molybdenum | 0.5 max. |
| Cobalt | 0–20 |
| Titanium | 1–3 |
| Aluminum | 0.2 max. |
| Niobium | 5–7 |
| Vanadium | 0.5 max. |
| Zirconium | 0.1 max. |
| Boron | 0–0.02 |
| Copper | 0.8 max. |
| Tungsten | 0.5 max. |

and the balance is essentially iron, wherein (a) $\% Nb \geqq 6.7 - 0.5(\% Ti)$ when $Ti \leqq 1.5\%$:

(b) $\% Nb \geqq 18.3 - 8.2(\% Ti)$ when $Ti \geqq 1.5\%$;

(c) $\% Ti \leqq 0.67(\% Nb) - 1.3$; and the sum, $\% Mn \times \% Cr + \% Mo + \% V + \% Cu + \% W \leqq 2$.

2. The alloy set forth in claim 1 containing at least about 5.2% niobium.

3. The alloy set forth in claim 1 containing at least about 0.1% silicon.

4. The alloy set forth in claim 1 containing at least about 5% cobalt.

5. The alloy set forth in claim 1 containing at least a small but effective amount of boron.

6. The alloy set forth in claim 1 containing at least about 1.2% titanium.

7. The alloy set forth in claim 2 containing not more than about 2.5% titanium.

8. The alloy set forth in claim 2 containing not more than about 6.5% niobium.

9. The alloy set forth in claim 3 containing not more than about 0.5% silicon.

10. The alloy set forth in claim 8 containing not more than about 2.4% titanium.

11. A precipitation hardenable, nickel-iron base alloy said alloy being balanced for precipitating a globular intermetallic phase and having a good combination of elevated temperature strength and ductility, consisting essentially of, in weight percent, about:

| | wt. % |
|---|---|
| C | 0.05 max. |

-continued

| | wt. % |
|---|---|
| Mn | 0.5 max. |
| Si | 0.1–0.5 |
| P | 0.005 max. |
| S | 0.005 max. |
| Cr | 0.8 max. |
| Ni | 35–42 |
| Mo | 0.5 max. |
| Co | 5–18 |
| Ti | 1.2–2.5 |
| Al | [0.2 max.] 0.1 max. |
| Nb | 5.2–6.5 |
| V | 0.5 max. |
| Zr | 0.1 max |
| B | a small but effective amount up to 0.02 |
| Cu | 0.8 max. |
| W | 0.5 max. |

and the balance is essentially iron, wherein (a) % Nb≧6.7−0.5(% Ti) for Ti≦1.5%;

(b) % Nb≧18.3−8.2(% Ti) for Ti≧1.5%;

(c) % Ti≦0.67(% Nb)−1.3; and the sum, % Mn+% Cr +% Mo +% V+% Cu+% W≦2.

12. The alloy set forth in claim 11 containing at least about 5.4% niobium.

13. The alloy set forth in claim 12 containing not more than about 2.4% titanium.

14. The alloy set forth in claim 12 containing not more than about 6.4% niobium.

15. The alloy set forth in claim 14 containing at least about 0.2% silicon.

16. The alloy set forth in claim 15 containing not more than about 0.4% silicon.

17. A precipitation hardenable, nickel-iron base alloy said alloy being balanced for precipitating a globular intermetallic phase and having a good combination of elevated temperature strength and ductility, consisting essentially of, in weight percent, about:

| | wt. % |
|---|---|
| C | 0.03 max. |
| Mn | 0.2 max. |
| Si | 0.2–0.4 |
| P | 0.005 max. |
| S | 0.005 max. |
| Cr | 0.5 max. |
| Ni | 36–40 |
| Mo | 0.2 max. |
| Co | 10–17 |
| Ti | 1.5–2.4 |
| Al | 0.1 max. |
| Nb | 5.4–6.4 |
| V | 0.2 max. |
| Zr | 0.05 max. |
| B | 0.002–0.01 |
| Cu | 0.5 max. |
| W | 0.2 max. |

and the balance is essentially iron, wherein (a) % Nb≧18.3−8.2(% Ti);

(b) % Ti≦0.67(% Nb)−1.3; and the sum, % Mn+% Cr+% Mo+% V+% Cu+% W≦1.

18. An article formed of a precipitation hardenable, nickel-iron base alloy consisting essentially of, in weight percent, about:

| | wt. % |
|---|---|
| Carbon | 0.1 max. |
| Manganese | 0.5 max. |
| Silicon | A small but effective amount up to 0.7 |
| Phosphorus | 0.015 max. |
| Sulfur | 0.010 max. |
| Chromium | 0.8 max. |
| Nickel | 32–52 |
| Molybdenum | 0.5 max. |
| Cobalt | 0–20 |
| Titanium | 1–3 |
| Aluminum | 0.2 max. |
| Niobium | 5–7 |
| Vanadium | 0.5 max. |
| Zirconium | 0.1 max. |
| Boron | 0–0.02 |
| Copper | 0.8 max. |
| Tungsten | 0.5 max. |

and the balance of the alloy is essentially iron, the composition of said alloy being controlled such that (a) % Nb≧6.7−0.5(% Ti) when Ti≦1.5%;

(b) % Nb≧18.3−8.2(% Ti) when T≧1.5%;

(c) % Ti≦0.67(% Nb)−1.3; and the sum, % Mn+% Cr+% Mo+% V+% Cu+% W≦2;

whereby said article exhibits high yield strength at elevated temperature in combination with excellent notch rupture ductility.

19. An article as set forth in claim 18 wherein the alloy contains at least about 5.2% niobium.

20. An article as set forth in claim 18 wherein the alloy contains not more than about 2.5% titanium.

21. An article as set forth in claim 18 wherein the alloy contains not more than about 6.5% niobium.

22. An article as set forth in claim 18 wherein the alloy contains not more than about 2.4% titanium.

23. An article as set forth in claim 18 wherein the alloy contains at least about 0.1% silicon.

24. An article as set forth in claim 18 wherein the alloy contains not more than about 0.5% silicon.

25. An article as set forth in claim 18 wherein the alloy contains at least about 5% cobalt.

26. An article as set forth in claim 18 wherein the alloy contains at least a small but effective amount of boron.

27. An article as set forth in claim 18 wherein the alloy contains at least about 1.2% titanium.

* * * * *

UNITED STATES PATENT AND TRADEMARK OFFICE

CERTIFICATE OF CORRECTION

PATENT NO. : 5,066,458

DATED : November 19, 1991

INVENTOR(S) : EDWARD A. WANNER and SUNIL WIDGE

It is certified that error appears in the above-identified patent and that said Letters Patent is hereby corrected as shown below:

Column 3:

Line 40: "to" should be --too--;

Line 50: "higher" should be --high--.

Column 6:

Line 8: after "2050-2175F. for" insert --24 hours--;

Line 28: insert --,-- (a comma) after "cooling";

Line 50: "100F" should be --100F°--.

Column 11:

Line 1: "100F" should be --1800F--.

Column 12:

Line 40: after "Mn", "x" should be -- + --.

Column 13:

In the first table, under column headed "wt. %", delete [0.2 max.] for the entry next to "Al".

Signed and Sealed this

Thirtieth Day of March, 1993

*Attest:*

STEPHEN G. KUNIN

*Attesting Officer*

*Acting Commissioner of Patents and Trademarks*